United States Patent [19]

Aoki et al.

[11] 4,263,828

[45] Apr. 28, 1981

[54] ELECTRONIC MUSICAL INSTRUMENT HAVING ENVELOPE CONTROLLED AUTOMATIC PERFORMANCE

[75] Inventors: Eiichiro Aoki; Akio Imamura; Norio Tomisawa, all of Hamamatsu, Japan

[73] Assignee: Nippon Gakki Seizo Kabushiki Kaisha, Hamamatsu, Japan

[21] Appl. No.: 13,966

[22] Filed: Feb. 22, 1979

[30] Foreign Application Priority Data

Feb. 23, 1978 [JP] Japan ..... 53-20329

[51] Int. Cl.[3] ..... G10F 1/00

[52] U.S. Cl. ..... 84/1.03; 84/1.26; 84/DIG. 12

[58] Field of Search ..... 84/1.03, 1.13, 1.26, 84/DIG. 12

[56] References Cited

U.S. PATENT DOCUMENTS 3,854,365 12/1974 Tomisawa et al. ..... 84/1.03

3,878,750 4/1975 Kapps ..... 84/1.03

4,010,667 3/1977 Kniepkamp ..... 84/1.03

*Primary Examiner*—J. V. Truhe

*Assistant Examiner*—Forester W. Isen

*Attorney, Agent, or Firm*—Spensley, Horn, Jubas & Lubitz

[57] ABSTRACT

An electronic musical instrument having an automatic performance device includes a memory storing in addition to automatic performance data, envelope control data for controlling envelopes of automatic performance tones to be generated. The envelope control data has two logical values and is used for controlling the envelope of the tone at the decaying portion. The value "0" designates a gradual decay and the value "1" designates a quick decay. The automatic performance tones are respectively imparted with either of the gradual and the quick decay shapes suitable for the time intervals between the generated tones in the designated automatic performance pattern.

8 Claims, 5 Drawing Figures

KEY BOARD SWITCH CIRCUIT
13
30
12
14
SW3
AUTOMATIC PERFORMANCE TONE GENERATION CIRCUIT
(C1 - 4*)
24
LATCH
MT
ENVELOPE IMPARTING CIRCUIT
16
EV
31
ONE SHOT
KON'
17
C1 C2 C3 C4
KON
32
15
AUTOMATIC PERFORMANCE PATTERN GENERATION CIRCUIT
SW2
34
DMP
ENVELOPE GENERATION CIRCUIT
10
33
"1"
PATTERN SELECTION
11
SW1

ELECTRONIC MUSICAL INSTRUMENT HAVING ENVELOPE CONTROLLED AUTOMATIC PERFORMANCE

BACKGROUND OF THE INVENTION

This invention relates to electronic musical instruments, and more particularly to the envelope control automatic performance tone production in an electronic musical instrument which carries out automatic performances such as automatic bass, chord and arpeggio performances.

U. S. patent application No. 825443, filed Aug. 17, 1977, and U.S. patent application No. 952098, filed Oct. 17, 1978, both assigned to the same assignee as the present case, disclose a technique wherein automatic bass or arpeggio tone production rhythm patterns timings are stored in a read-only memory (hereinafter referred to merely as "a ROM" when applicable), and are read out according to the tempo signal. In these prior inventions, the pattern data stored in the ROM include only such data as indicate the pitches of automatic performance notes, and the envelopes of the automatic performance tones are not controlled in accordance with patterns; that is, the envelopes are shaped in a predetermined characteristic. Accordingly, in the case of using an envelope waveform having a decaying tail an envelope of a tone tends to rise before an envelope of an immediately preceding tone is sufficiently decayed. This tendency is increased as the time intervals of the automatic performance tone productions become short. Thus, the successively produced tones give an impression that they are not sufficiently separated from one another.

SUMMARY OF THE INVENTION

Accordingly, an object of this invention is to eliminate the above-described difficulty accompanying a prior art electronic musical instrument.

More specifically, an object of the invention is to provide an electronic musical instrument in which data controlling the envelope shapes of the tones are stored, in addition to data specifying tones (for instance, pitch data) to be provided, in the ROM adapted to store automatic performance tone production patterns, whereby automatic performance tone envelopes are automatically controlled according to a predetermined pattern.

Thus, the above-described difficulty can be eliminated by setting an envelope controlling pattern in such a manner that the decay times are short for tones whose sounding time intervals are short.

DETAILED DESCRIPTION OF THE INVENTION

Figure 1:
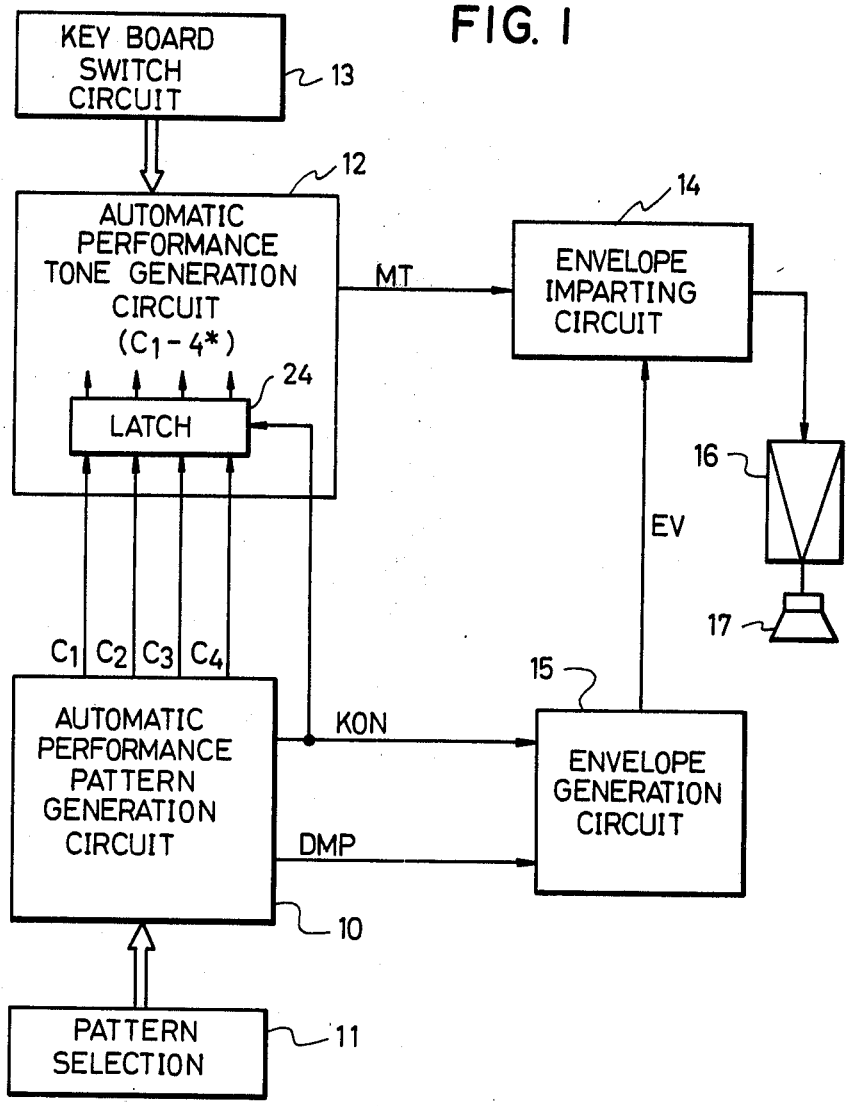
FIG. 1 is a block diagram showing the entire arrangement of one example of an electronic musical instrument according to this invention.

The entire arrangement of one preferred example of an automatic musical instrument according to this invention is shown in FIG. 1. In this figure, an automatic performance pattern generation circuit 10 comprises a read-only memory (ROM) which stores a plurality of automatic performance patterns which can be selected by a pattern selection circuit 11, thus providing an automatic performance pattern in response to the selecting operation of the pattern selection circuit 11. Any one of the patterns consists of data concerning tones forming one (or a plurality of) phrase of automatic performance, and the pattern of one (or plural) phrase is repeatedly generated. In this invention, a pattern for designating tones to be generated (hereinafter referred to as "tones-to-be-generated" when applicable) at respective tone production timings in one (or plural) phrase, and also a pattern for controlling the amplitude envelopes of the tones-to-be-generated are provided by the automatic performance pattern generation circuit 10. The tone designating pattern is in the form of a tone designating code $C_1$–$C_4$ (of four bits), and the envelope controlling pattern is in the form of an envelope controlling code DMP (which is a one-bit code in this example).

The tone designating codes $C_1$–$C_4$ are applied to an automatic performance tone generation circuit 12, where musical tone signals MT designated by the codes $C_1$–$C_4$ are generated at the respective designated timings. Signals from a keyboard switch circuit 13 are applied to the automatic performance tone generation circuit 12. Accordingly, the musical tone signals MT for the automatic performance are generated according to both the state of key depression in the keyboard and the tone designating codes $C_1$–$C_4$.

The details of the operation of the automatic performance tone generation circuit 12 vary suitably according to the kinds of the automatic performance. For instance, in the case of the automatic bass performance, the tone designating codes $C_1$–$C_4$ are applied to the automatic performance tone generation circuit 12 as data each representative of a note interval between each tone-to-be generated and the root note. The keyboard switch circuit 13 operates to designate a chord by key depression. In the automatic performance tone generation circuit 12, the signals MT of the notes which are in the note-interval relations designated by the tone designating codes $C_1$–$C_4$ which respect to the root note of the chord are generated. In the case of the automatic arpeggio performance, the tone designating code $C_1$–$C_4$ is employed as data representative of the order of tones (or instance, the order in tone pitch). In the keyboard switch circuit 13, a plurality of arpeggio composing (constituent) tones designated by key depression are detected, and the resultant detection signals are applied to the automatic performance tone generation circuit 12. In this circuit 12, among the arpeggio composing tones designated by the key depression, tones are selected according to the orders designated by the codes $C_1$–$C_4$ so that the musical tone signals MT of the tones thus selected are generated. In this case, the codes $C_1$–$C_4$ are data that designated the orders from the highest (or from the lowest) of the tones which are to be selected. In practice, the automatic performance tone generation circuit 12 can be formed by application of the automatic performance device disclosed in the specification of U.S. patent application No. 825443 or U.S. patent application No. 952098 or by a conventional automatic performance device. However, detailed description of this circuit 12 will not be made because the circuit 12 does not fall in the essential matter of this invention.

The musical tone signal MT for automatic performance generated by the automatic performance tone generation circuit 12 is applied to an envelope imparting circuit 14. This envelope imparting circuit 14 operates to form the amplitude envelopes of the musical tone signals MT according to the shape of an envelope shape signal EV supplied thereto from an envelope generation circuit 15. An automatic performance tone signal to which an amplitude envelope has been given is applied through an amplifier 16 to a loudspeaker 17 from which it is sounded as a musical tone.

Applied to the envelope generation circuit 15 is a key-on signal KON which defines the tone production timing of an automatic performance tone, and the aforementioned envelope controlling code DMP provided by the automatic performance pattern generation circuit 10. The key-on signal KON is generated in synchronization with the rise timing of the automatic performance tone. In response to this key-on signal KON, one envelope shape signal EV is generated by the envelope generation circuit 15. In the example shown in FIG. 1, the key-on signal KON is provided by the automatic performance pattern generation circuit 10; however, the circuitry may be so designed that the key-on signal KON is provided by the automatic performance tone generation circuit 12. The envelope controlling code DMP is to control the wave shape of the envelope shape signal EV which is produced in response to the key-on signal KON.

In this example, the control of an envelope by a pattern is made for a decay portion of the envelope. More specifically, the control of a decay characteristic which is generally called "damping" is incorporated in the automatic performance pattern. When the envelope controlling code DMP is at a logical level "0" (hereinafter referred to merely as "0"), the envelope shape is not damped; that is, the envelope shape is decayed in the ordinary decaying time (i.e. a long decaying time). When the code DMP is at a logical level "1" (hereinafter referred to merely as "1"), the envelope shape is damped; that is, the decaying time is shortened.

Figure 2:
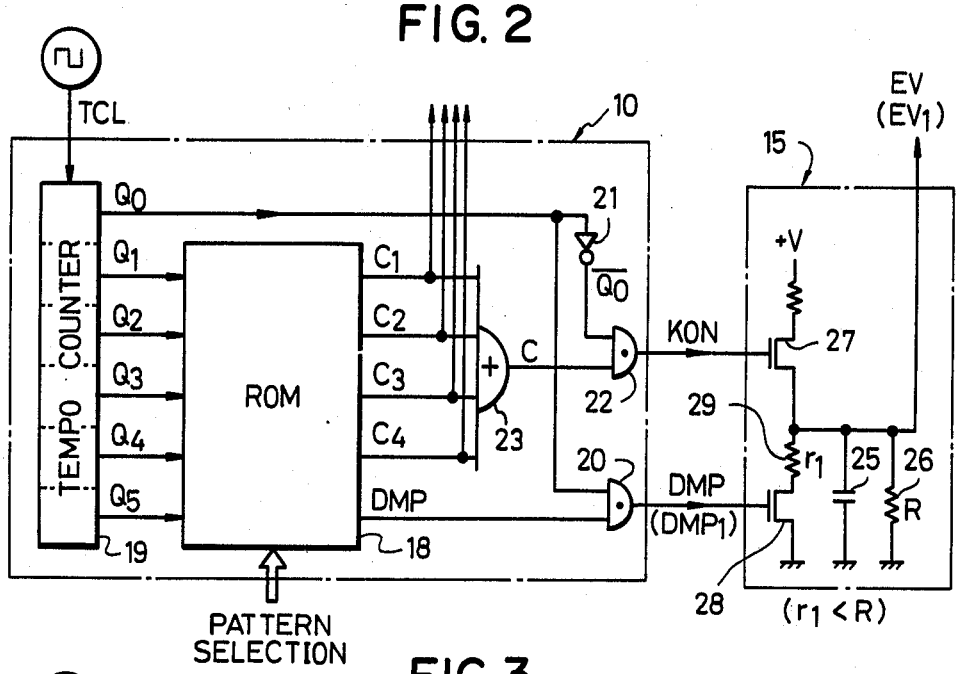
FIG. 2 is a circuit diagram, partly drawn as a block diagram, showing a detailed example of an automatic performance pattern generation circuit and an envelope generation circuit shown in FIG. 1.
Figure 3:
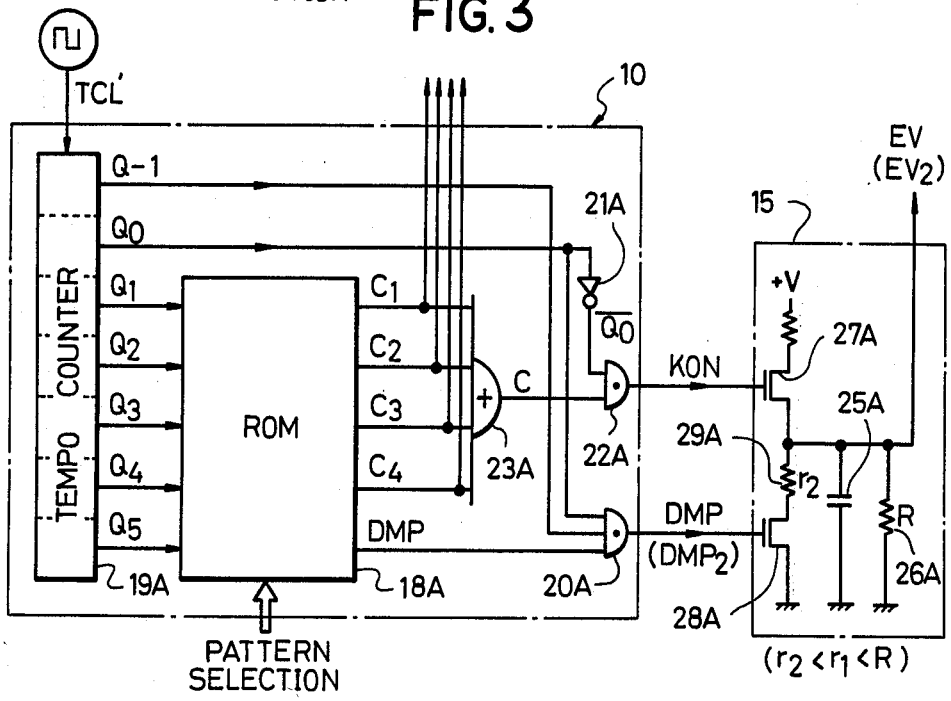
FIG. 3 is a circuit diagram, partly drawn as a block diagram, showing one modification of the circuitry shown in FIG. 2.

FIGS. 2 and 3 show examples of the arrangement of the automatic performance pattern generation circuit 10 and the envelope generation circuit 15, employed in the case where the above-described "damp control" is effected by means of the envelope controlling code DMP.

In the example shown in FIG. 2, a first system is employed in which, in the case of damping an envelope shape, a whole decay envelope is formed by a single exponential function for shortening the decaying time. One example of the envelope shape signal EV which is damped by the first system is shown in the part (k) of FIG. 4. In the example shown in FIG. 3, a second system is employed in which the decay envelope is formed in two steps by two exponential functions and the level of the envelope shape is lowered to zero instaneously in the second exponential function, so that a short decaying time as a whole is obtained. One example of the envelope shape signal EV which is damped by the second system is shown in the part (m) of FIG. 4.

First System

In the automatic performance pattern generation circuit 10 shown in FIG. 2, a pattern read-only memory (ROM) 18 stores a plurality of automatic performance patterns, and a pattern is selected with the aid of the signal from the pattern selection circuit 11 (FIG. 1) as was described before. The pattern thus selected is read out with the aid of the output $Q_1$–$Q_5$ of a tempo counter 19 every automatic tone generation timing. At each automatic tone generation timing, the generation tone designating code $C_1$–$C_4$ and the envelope controlling code DMP are read out. The tempo counter 19 is a 6-bit binary counter adapted to count tempo clock pulses TCL, five bits thereof counting from the most significant bit side are utilized as an address input to the ROM 18. The least significant bit $Q_0$ is applied to an AND circuit 20, and it is then inverted by an inverter 21. The inverted signal $\overline{Q_0}$ is applied to an AND circuit 22.

The tone designating code $C_1$–$C_4$ is applied to an OR circuit 23, and it is utilized to form the key-on signal KON. That is because, when a tone should be produced, the code $C_1$–$C_4$ takes a value other than zero (0) and the output C of the OR circuit 23 is raised to "1". This output C of the OR circuit 23 is applied to an AND circuit 22, where it is selected at the timing of the signal $Q_0$, as a result of which the key-on signal KON is outputted by the AND circuit 22. The code DMP read out of the ROM 18 is applied to the AND circuit 20, where it is selected at the timing of the signal $\overline{Q_0}$, as a result of which an envelope controlling code DMP (or $DMP_1$) for the first system is obtained. As the phase of the signal $\overline{Q_0}$ leads the phase of the signal $Q_0$ by $\pi$, the key-on signal KON selected by the signal $\overline{Q_0}$ is produced earlier than the code $DMP_1$ selected by the signal $Q_0$.

The operation of the circuitry shown in FIG. 2 will be described with reference to one pattern for the automatic bass performance in which automatic performance is conducted in the order of "prime (root) note"—"rest"—"third note"—"fifth" as shown in the part (a) of FIG. 4.

Figure 4:
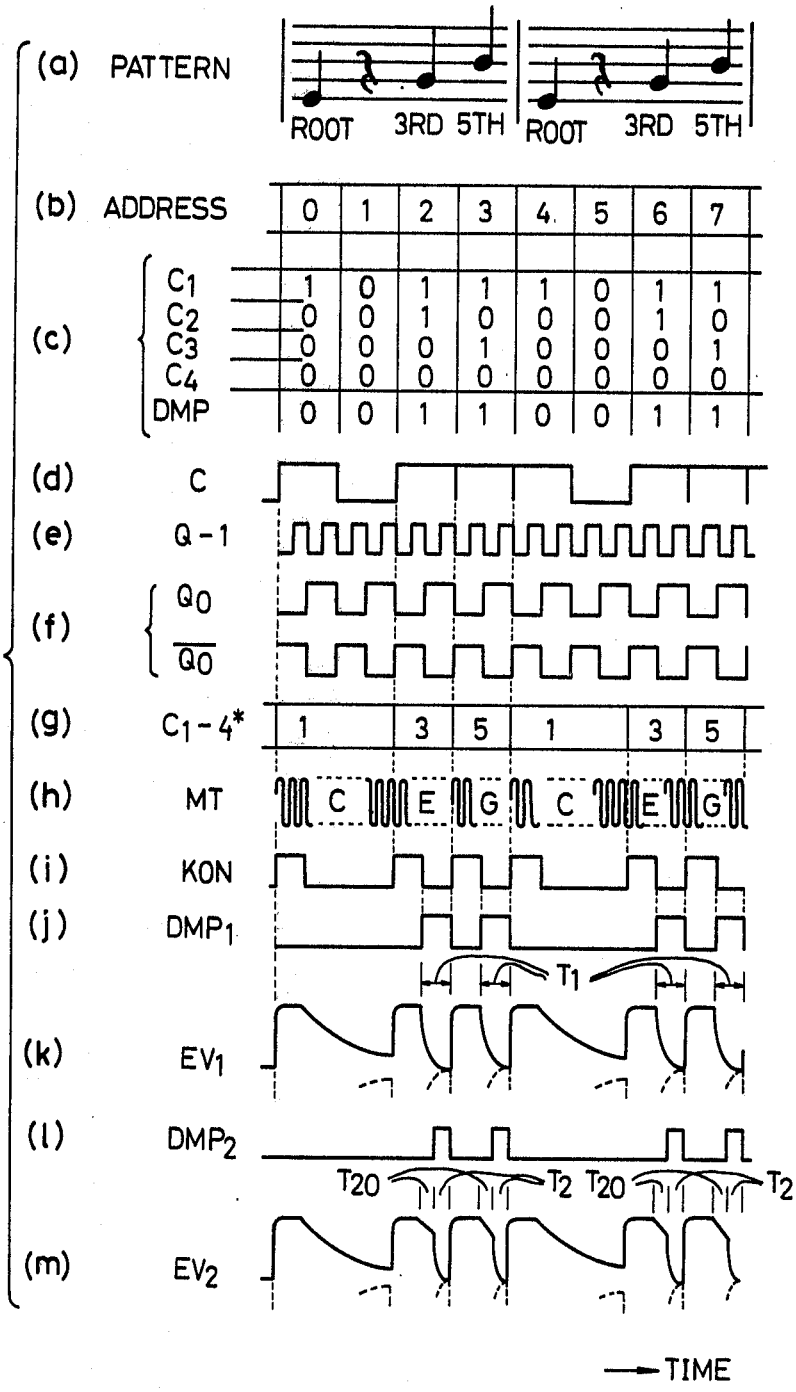
FIG. 4 is a timing chart for description of the operations of the circuits shown in FIGS. 2 and 3.

As the address of the ROM 18 designated by the output $Q_1$–$Q_5$ of the tempo counter 19 is changed as indicated in the part (b) of FIG. 4, the tones-to-be-generated designating code $C_1$–$C_4$ and the envelope controlling code DMP are changed as indicated in the part (c) of FIG. 4. The code $C_1$–$C_4$ is "0 0 0 1" designating prime note at the address 0 and 4, "0 0 0 0" designating no note at the address 1 and 5, "0 0 1 1" designating the third note at the address 2 and 6, and "0 1 0 1" designating the fifth note at the address 3 and 7. The code DMP is "1" indicating damping at the address 2, 3, 6 and 7 in correspondence to the third and fifth notes which are short in tone production time interval, and the code DMP is "0" at the other addresses.

In the case where the code $C_1$–$C_4$ designates tone production, the output C of the OR circuit 23 assumes a form an indicated in the part (d) of FIG. 4. The signal $Q_0$ which is less significant by one bit than the address signal $Q_1$ and its inverted signal $\overline{Q_0}$ are produced as shown in the part (f) of FIG. 4, dividing one address interval into two parts. That is, in the first half of one address interval, the signal $Q_0$ is at "1", but in the second half the signal $\overline{Q_0}$ is at "1". Therefore, the key-on signal KON which is the logical product of the output C of the OR circuit 23 and the signal $\overline{Q_0}$ is produced as indicated in the part (i) of FIG. 4. The code $DMP_1$ which is the logical product of the code DMP and the signal $Q_0$ is provided as indicated in the part (j) of FIG. 4. This code $DMP_1$ is provided only in the second half of each of the addresses 2, 3, 6 and 7.

The tone designating code $C_1$–$C_4$ is supplied to the automatic performance tone generation circuit 12, where it is latched by, for instance, a latch circuit 24 in FIG. 1. In FIG. 1, the latching operation of the latch circuit 24 is effected with the aid of the key-on signal KON. The decimal number of the tone designating code latched by the latch circuit 24 (which will be designated by $C_{1\text{-}4}$*) is as indicated in the part (g) of FIG. 4. In the automatic performance tone generation circuit 12, the musical tone signal MT is produced as indicated in the part (h) of FIG. 4 in correspondence to the $C_{1\text{-}4}$* latched. In the part (h) of FIG. 4, the prime is indicated as note C; the third as note E; and fifth as note G.

Referring back to FIG. 2, the envelope generation circuit 15 comprises a time constant circuit consisting of a capacitor 25 and a resistor 26. A field-effect transistor (hereinafter referred to as "an FET" when applicable) 27 is rendered conductive by the key-on signal KON, as a result of which the capacitor 25 is charged. When the key-on signal KON is lowered to "0", the FET 27 is rendered non-conductive, and the capacitor 25 therefore is discharged through the resistor 26. The voltage of the capacitor 25 with respect to ground is obtained as the envelope waveform signal EV, and is then applied to the envelope control circuit 14 (FIG. 1). The attenuation characteristic (decay envelope) of the envelope waveform is obtained by the discharge of the capacitor 25.

The envelope controlling code $DMP_1$ is applied to the gate of a FET 28. When the code $DMP_1$ is at "0", the capacitor 25 is discharged only through the resistor 26, and therefore the decaying time is relatively long. When the code $DMP_1$ is at "1," the FET 28 is rendered conductive, and the capacitor 25 is discharged through a parallel circuit of the resistor 26 and a resistor 29. The resistance $r_1$ of the resistor 29 connected in series to the FET 28 is smaller than the resistance R of the resistor 26. Therefore, in the case where the FET 28 is rendered conductive by the code $DMP_1$, the decaying time is shorter.

The part (k) of FIG. 4 shows the envelope waveform signal EV ($EV_1$) in the first system, and more specifically indicates the fact that a short decay envelope is obtained with a short time constant in response to the level "1" of the code $DMP_1$ in the second half of each of the addresses 2, 3, 6 and 7 (as indicated by reference character $T_1$). It is apparent from FIG. 4 that the tone in the other case (i.e. the tone which is long in the tone production interval) is slowly decayed. Accordingly, it can be understood from the above-described example that even if the tone production interval of automatic tones becomes short, one can hear the automatic tones as separated and distinct tones.

Second System

In the automatic performance pattern generation circuit 10 shown in FIG. 3, the contents of a pattern ROM 18A is the same as those of the ROM 18A in FIG. 2. In addition, the operations of an inverter, 21A, and AND circuit 22A and an OR circuit 23A are the same as those of the inverter 21, the AND circuit 22 and the OR circuit 23 in FIG. 2. The period of a tempo clock TCL' is substantially a half of that of the tempo clock TCL in FIG. 2. A tempo counter 19A is a 7-bit binary counter. The six more significant bits $Q_0$–$Q_5$ of the counter 19A are equal to the output $Q_0$–$Q_5$ of the counter 19 in FIG. 2. The bit $Q_{-1}$ which is less significant than the bit $Q_0$ by one bit is a duty 50% pulse with a pulse period of $\frac{1}{2}$ of one address interval. The AND circuit 20A is a 3-input AND circuit to which the envelope controlling code DMP from the ROM 18A, and signals $Q_0$ and $Q_{-1}$ are applied. Thus, an envelope controlling code $DMP_2$ for the second system which is outputted by the AND circuit 20A is raised to "1" in correspondence to an address, where the code DMP is at "1", and in the last $\frac{1}{4}$ of the address interval (or when the AND logic $DMP \cdot Q_0 \cdot Q_{-1}$ is obtained). (cf. the part (l) of FIG. 4).

In the envelope generation circuit 15 in FIG. 3, the operations of a capacitor 25A, a resistor 26A and a FET 27A are similar to those of the elements 25, 26 and 27 in FIG. 2. The code $DMP_2$ from the AND circuit 20A is applied to FET 28A, and the resistance $r_2$ of a resistor 29A connected in series to the FET 28A is smaller than the resistance R of the resistor 26, and is smaller than the resistance of the resistor 29 in FIG. 2 ($r_2 < r_1 < R$). Therefore, the capacitor 25A is discharged through a parallel circuit of the resistors 26A and resistor 29A with a time constant much shorter than that in the case of FIG. 2; that is, the capacitor 25A is discharged instantaneously (nearly resembling a short-circuit time constant.

The formation of a short decay envelope according to the second system will be described with reference to the part (m) of FIG. 4.

When the key-on signal KON provided in the first half of each of the addresses 2, 3, 6 and 7 is lowered to "0" in the second half, discharging from the capacitor 25A is started. In the first half of this second half (or the third $\frac{1}{4}$ interval in the case where one address interval is equally divided into four parts), the envelope controlling code $DMP_2$ is still at "0", and therefore the envelope waveform is decay with a large time constant based on the resistor 26A. This decay part is designated by interval $T_{20}$. In the second half of that second half interval (or the last $\frac{1}{4}$ of one address interval), the envelope controlling code $DMP_2$ is raised to "1", and therefore the charges remaining in the capacitor 25A are discharged with an extremely small time constant based on the resistors 26A and 29A (R and $r_2$). This interval is designated by reference character $T_2$. In this interval $T_2$, the envelope waveform signal EV ($EV_2$) disappears instantaneously.

Thus, in the second system, the short decay envelope waveform is decayed in two steps.

The first system and the second system have been described separately; however, it will be appreciated that these two systems can be employed in combination. That is, it is possible to generate the envelope controlling code ($DMP_1$) for the first system at one automatic performance tone generation timing and to generate the envelope controlling code ($DMP_2$) for the second system at another automatic performance tone generation timing. This can be achieved by designing the envelope generation circuit 15 so that it can generate the envelope waveform in both of the systems, i.e., by connecting the FET 28A and the resistor 29A for the second system in parallel to the path of the FET 28 and the resistor 29 in FIG. 2.

In the above-described example, the RC time constant circuit is employed as the envelope generation circuit 15; however, the invention is not limited thereto or thereby; that is, it is obvious that a circuit designed to read the envelope waveform memory with digital signals may be employed.

Figure 5:
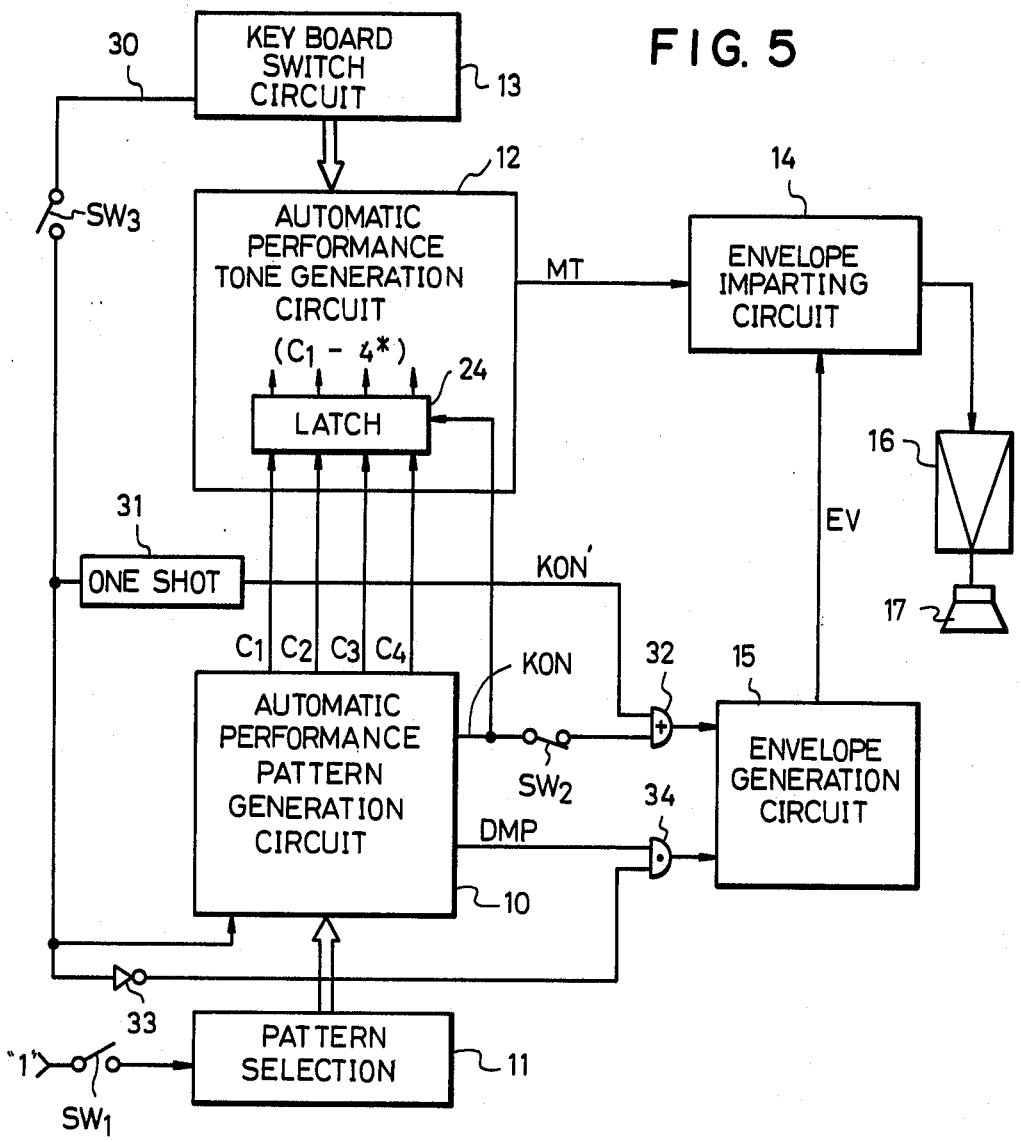
FIG. 5 is a block diagram showing the entire arrangement of another example of an electronic musical instrument according to the invention.

Shown in FIG. 5 is another example of the electronic musical instrument according to the invention, in which a function of suspending progress of the automatic performance according to the automatic performance pattern is additionally provided.

In FIG. 5, circuits designated by reference numerals 10, 11, 12, 13, 14, 15, 16 and 17 are equal in function to those similarly numbered in FIG. 1. Switches $SW_1$, $SW_2$ and $SW_3$ are additionally provided. These switches are gang operated. in association with one another. The switches $SW_1$ and $SW_3$ are normally open switches, and the switch $SW_2$ is a normally closed switch.

In the ordinary case (i.e. in the case where the switches $SW_1$ through $SW_3$ are not operated) the switches $SW_1$ and $SW_2$ are open and the switch $SW_2$ is closed as shown in FIG. 5. Accordingly, in the ordinary case, the device shown in FIG. 5 operates similarly as the device described with reference to FIGS. 1 through 4; that is, an automatic performance pattern selected by the pattern selection circuit 11 is read out of the ROM 18 (18A) in accordance with the output $Q_1$–$Q_5$ of the tempo counter 19 (19A) successively, and the automatic performance is effected according to this pattern.

When the switch $SW_1$ is closed, the operation of the pattern selection circuit 11 is stopped, and simultaneously the switch $SW_2$ is opened while the switch $SW_3$ is closed. Upon depression of a key in the keyboard, a signal "1" is supplied from the keyboard switch circuit 13 to the switch $SW_3$ through a line 30. This signal "1" is applied through the closed switch $SW_3$ to a one-shot circuit 31, whereby a key-on signal KON' having a predetermined time width is provided. The key-on signal KON' is applied through an OR circuit 32 to the envelope generation circuit 15, as a result of which the envelope shape signal EV is generated. In this operation, the switch $SW_2$ is open, and therefore the signal KON from the automatic performance pattern generation circuit 10 is not applied to the envelope generation circuit 15. On the other hand, the signal "1" supplied through the switch $SW_3$ in response to the key depression is applied to the automatic performance pattern generation circuit 10, as a result of which the tone designating code $C_1$–$C_4$ and the envelope controlling code DMP concerning the tone of the first beat in the automatic performance pattern are continuously read out of the pattern ROM 18 (18A). In this case, the output of the tempo counter 19 (19A) is prevented from being used for reading the pattern ROM 18 (18A) by the signal from the pattern selection circuit 11 which has been disabled by the switch $SW_1$. The signal "1" supplied through the switch $SW_3$ is inverted by an inverter 33, whereby an AND circuit 34 is disabled. Thus, the application of the envelope controlling code DMP is stopped by the AND circuit 34, that is, it is not applied to the envelope generation circuit 15.

As is apparent from the above description, when the switches $SW_1$ through $SW_3$ are operated, the progress of automatic performance according to the automatic performance pattern is suspended, and the tone of the first beat of the pattern is continuously produced in response to the tone designating code $C_1$–$C_4$. In this operation, the envelope controlling code DMP concerning the tone of the first beat is continuously supplied; however, it is not applied to the envelope generation circuit 15 because the AND circuit 34 is maintained disabled during the key depression. Upon release of the key in the keyboard, the signal supplied to the line 30 from the keyboard switch circuit 30 is set to "0". This signal "0" is applied through the inverter 33 to the AND circuit 34 thereby to enable the latter 34. As a result, the envelope controlling code DMP is applied to the envelope generation circuit 15, and the envelope shape is controlled in accordance with the contents of the code DMP. In other words, when the code DMP is at "1," the envelope shape is quickly vanishing, that is, a damped envelope shape is obtained. When the code DMP is at "0," the envelope shape is gradually decaying at the ordinary decaying rate.

What is claimed is:

1. In an electronic musical instrument of the type having an automatic performance device, the improvement comprising:

a memory in which a set of data specifying the tonal relationships between a sequence of automatic performance tones is stored, means for reading out said memory sequentially at a rate establishing a rhythmic pattern for the resultantly produced automatic performance tones, said data being in said memory as parallel binary codes which do not themselves represent specific musical notes, said instrument including means for combining said read out automatic performance data with additional note information to establish the actual note names of tones to be produced in accordance with said predetermined tonal relationships, said memory also storing envelope decay controlling codes associated with respective data in said set and read out in unison therewith, circuitry means for producing a key-on signal as each data and associated code are read out from said memory, tone production being initiated in response to occurrence of said key-on signal, first envelope control means for imparting a first amplitude envelope decay characteristic for each produced tone for which the associated envelope decay controlling code has a first value, and second envelope control means, operative at a certain time after initiation of tone production in response to readout of data in said set, for imparting to each produced tone for which the associated envelope decay controlling code has a second value, a second amplitude envelope decay characteristic having a more rapid decay than said first characteristic.

2. An electronic musical instrument according to claim 1 further comprising:

a counter advanced by a clock, the contents of a portion of said counter being used for addressing said memory to sequentially read out said set of data and the associated envelope decay controlling codes, and means for deriving from the contents of said counter timing control signals at multiples of the rate at which said data and codes are sequentially read out, said second envelope control means utilizing said timing control signals to establish said certain time.

3. An electronic musical instrument according to claim 2 including circuitry for utilizing said timing control signals to terminate said key-on signal at said certain time, the amplitude envelope decay characteristic of said produced tone then being established by said first or second envelope control means in accordance with whether said envelope decay controlling code has said first or second value.

4. An electronic musical instrument according to claim 2 including circuitry for utilizing said timing control signals to terminate said key-on signal after a fixed time interval shorter than said certain time, the amplitude envelope decay characteristic of said produced tone than being established by said first envelope control means for an additional time interval ending at said certain time, the amplitude envelope decay characteristic thereafter being established by said first or second envelope control means in accordance with whether said envelope decay controlling code has said first or second value.

5. In an electronic musical instrument of the type having an automatic performance device, the improvement comprising:

a memory in which a set of data specifying the tonal relationships between a sequence of automatic performance tones is stored and means for reading out said stored data sequentially at a rate establishing a rhythmic pattern for the resultantly produced automatic performance tones, said memory also storing envelope decay controlling codes associated with respective data in said set and read out in unison therewith, a counter advanced by a clock, the contents of a relatively high order portion of said counter being used for addressing said memory to sequentially read out said set of data and the associated envelope decay controlling codes, gating means, responsive to the contents of a relatively low order portion of said counter, for establishing a key-on control signal at the initiation of readout of each data and associated code, and for maintaining said key-on signal for a fixed duration of time less than the time between read-out of the data and codes for two consecutive tones, tone production being initiated upon occurrence of said key-on control signal, a decay characteristic being imparted to said produced tone beginning upon termination of said key-on control signal, first envelope control means for imparting a first amplitude envelope decay characteristic for each produced tone for which the associated envelope decay controlling code has a first value, and second envelope control means for imparting, to each produced tone for which the associated envelope decay controlling code has a second value, a second amplitude envelope decay characteristic having a more rapid decay than said first characteristic.

6. An electronic musical instrument according to claim 5 wherein, upon termination of said key-on control signal, said decay characteristic is imparted by said first or second envelope control means in accordance with whether said envelope decay controlling code has said first or second value.

7. An electronic musical instrument according to claim 5 wherein, upon termination of said key-on control signal said decay characteristic first is imparted by said first envelope control means, and including:

damping gate means responsive to the relatively low order contents of said counter and operative after said first envelope control means has begun to impart said first decay characteristic, for thereafter causing said second envelope control means to impart to said produced tone said second decay characteristic if said envelope decay controlling code then has said second value.

8. An electronic musical instrument according to claim 1 wherein tone production is maintained at a substantially constant level from the initiation of said key-on signal until the termination of said key-on signal a certain time thereafter, said first or second envelope control means thereafter imparting said respective decay characteristic.

* * * * *